United States Patent [19]

Fender

[11] 4,220,069

[45] Sep. 2, 1980

[54] ELECTROMAGNETIC PICKUP FOR STRINGED MUSICAL INSTRUMENTS

[76] Inventor: C. Leo Fender, 2851 Rolling Hills Dr. Sp.33, Fullerton, Calif. 92635

[21] Appl. No.: 50,438

[22] Filed: Jun. 20, 1979

[51] Int. Cl.[3] ..... G10H 3/18

[52] U.S. Cl. ..... 84/1.15; 84/1.16

[58] Field of Search ..... 84/1.15, 1.16

[56] References Cited

U.S. PATENT DOCUMENTS

| | | | |
|---|---|---|---|
| 2,896,491 | 7/1959 | Lover | 84/1.15 |
| 2,911,871 | 11/1959 | Schultz | 84/1.15 |
| 3,236,930 | 2/1966 | Fender | 84/1.15 |
| 3,962,946 | 6/1976 | Rickard | 84/1.15 |
| 4,026,178 | 5/1977 | Fuller | 84/1.16 |
| 4,133,243 | 1/1979 | DiMarzio | 84/1.15 |

*Primary Examiner*—S. J. Witkowski

*Attorney, Agent, or Firm*—Philip M. Hinderstein

[57] ABSTRACT

A pickup for an electrical musical instrument of the stringed type including first and second pickup assemblies, each pickup assembly including a plurality of metallic, unmagnetized pole pieces operatively associated with the strings of the instrument, the pole pieces being aligned in parallel, spaced-apart relationship, generally perpendicular to the plane of the strings, first ends of all of the pole pieces being closely adjacent to the plane of the strings, second ends of all of the pole pieces being flat and planar. Each pickup assembly further includes a rectangular bar magnet having a first surface defining a north pole and an opposite second surface defining a south pole, the bar magnet of the first pickup assembly being positioned with the first surface thereof in surface contact with the second ends of all of the pole pieces of the first pickup assembly, the bar magnet of the second pickup assemgly being positioned with the second surface thereof in surface contact with the second ends of all the pole pieces of the second pickup assembly. Each of the pickup assemblies further includes coil means wound around the pole pieces thereof. A keeper is positioned in contact with the second surface of the first bar magnet and the first surface of the second bar magnet. In another embodiment, the pickup includes only a single pickup assembly.

17 Claims, 7 Drawing Figures

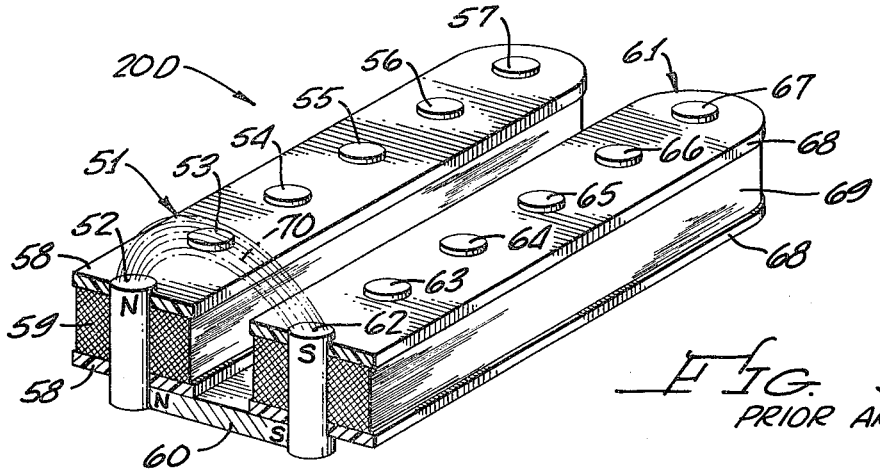
FIG. 5
PRIOR ART
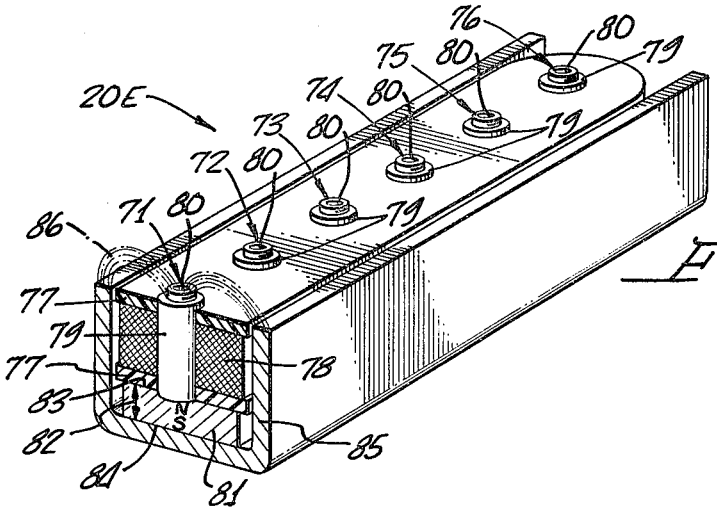
FIG. 6
FIG. 7
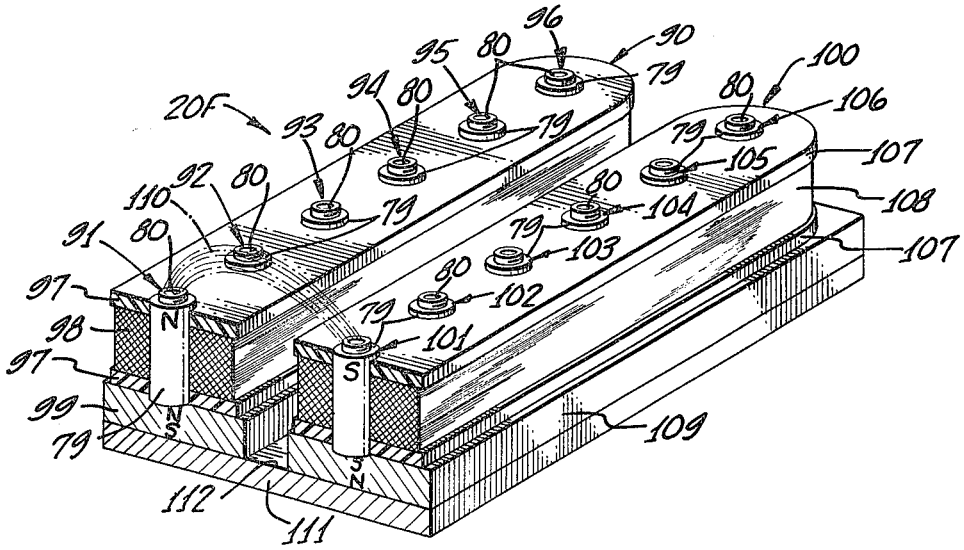

ELECTROMAGNETIC PICKUP FOR STRINGED MUSICAL INSTRUMENTS

BACKGROUND OF THE INVENTION

1. Field of the Invention

The present invention relates to an electromagnetic pickup for stringed musical instruments and, more particularly, to an electromagnetic pickup having a magnetic field which is significantly stronger and better defined than those of prior magnetic pickups.

2. Description of the Prior Art

The present invention relates broadly to electrical musical instruments of the stringed type. It is particularly applicable to an electric guitar or a similar musical instrument having a plurality of stretched strings extending across a body and a neck in which the strings are caused to vibrate by plucking or picking same.

In order to derive an output from such an electric guitar or other similar electrical musical instrument, the instrument is conventionally provided with an electromagnetic pickup comprising a number of magnetic elements (pole pieces) having wound therearound a conductive coil. Typically, one such pole piece is disposed directly beneath each string of the instrument. The strings are constructed of a magnetizable substance, such as steel, and, therefore, become part of the conductive path for the magnetic lines of flux of the pole pieces. Accordingly, when any of the strings are caused to vibrate, this causes a disturbance in the magnetic field of the associated pole pieces. This has the effect of generating a voltage in the conductive coil, which voltage may be suitably amplified and transmitted to a loudspeaker system.

In the past, the pole pieces have been magnetized in one of two primary ways. One common approach is to form each pole piece from a permanent magnetic material or to permanently magnetize a magnetizable material. This approach is exemplified by U.S. Pat. Nos. 3,236,930 and 3,962,946. For a variety of reasons, it is often preferred to make the pole pieces from a metallic, unmagnetized material, such as soft iron, and to use a separate magnet to produce the magnetic field through the pole pieces. For example, when using a bar magnet made from a permanent magnetic material, such as a ceramic magnet, it is often less expensive to provide a single bar magnet for use with a plurality of metallic, unmagnetized pole pieces that it is to permanently magnetize a single pole piece.

In any event, when a bar magnet is used with unmagnetized pole pieces, it is invariably the practice to position the magnet so that either the north or south pole engages the sides of the pole pieces, usually adjacent the ends thereof remote from the strings. As a practical matter, the bar magnet often makes line contact with the side of each pole piece and the magnetic lines of flux change in direction through an angle of 90° in passing from the bar magnet into the pole pieces. Sometimes, a single bar magnet is positioned between two rows of pole pieces for pickups having first and second pickup assemblies. In other cases, a pair of bar magnets are positioned on opposite sides of a single row of pole pieces in a pickup having a single pickup assembly. The former case is exemplified by U.S. Pat. No. 2,896,491. The latter case is exemplified by U.S. Pat. Nos. 2,911,871 and 4,133,243. Both arrangements are disclosed in U.S. Pat. No. 4,026,178.

It has been found that by using either magnetized pole pieces or metallic, unmagnetized pole pieces with one or more bar magnets engaging the side edges thereof, a relatively weak magnetic field is created and one which does not have a well-defined pattern of magnetic field lines. As a result, the output of a pickup incorporating this type of pickup assembly is not as rich in harmonics as one would like. However, no solution to this problem has been found heretofore.

Another problem which has been addressed heretofore with such electromagnetic pickups is that electric guitars and other similar electrical musical instruments are used in areas having strong magnetic fields from lighting fixtures, motors, transformers, and the like, and these magnetic fields are sensed by the pickup as an extraneous noise source. Furthermore, such source typically has a wide range of frequencies. These magnetic fields induce voltages in the pickup coils which are also amplified and transmitted to the loudspeaker system, manifesting themselves in an objectionable hum.

In order to overcome this problem, it is known to provide a pickup for an electrical musical instrument including a pair of identical pickup assemblies, each having a plurality of magnetic pole pieces and a coil, the pickup assemblies being positionable in parallel, spaced, closely-adjacent relationship. All of the pole pieces of one of the pickup assemblies have their north poles closely adjacent to the strings and their south poles relatively remote from the strings whereas all of the pole pieces of the other pickup assembly have their south poles closely adjacent to the strings and their north poles relatively remote from the strings. The coils of the two pickup assemblies are wound in opposite directions and the two coils are electrically connected, conventionally either in series or in parallel. Because the direction of current flow in each coil is governed by the magnetic polarity, the direction of current flow in one coil is opposite to that of the other coil for each string. However, since the directions of the windings of the two coils are opposite, the signals induced in the coils as a result of string vibrations are additive and the output signal is the sum of the voltages induced in the coils.

On the other hand, signals picked up by the coils from noise sources produce currents in the coils which are independent of the magnetic polarity, and, accordingly, such noise sources produce voltages that are in phase. However, since the coils are wound in opposite directions, these in phase signals cancel and the output signal is the difference between the noise source voltages induced in each coil. This means that any noise from extraneous sources, which is otherwise manifested as an objectionable hum, is effectively reduced or canceled. It is for this reason that such an arrangement is typically characterized as a humbucking arrangement.

While humbucking pickups have come into common use in electric guitars and other similar electrical musical instruments, the method of magnetizing the pole pieces is still as described hereinbefore so that the output of the pickup is not as rich in harmonics as one would like it to be. This problem in humbucking type pickups has also remained unsolved heretofore.

SUMMARY OF THE INVENTION

According to the present invention, there is provided an electromagnetic pickup for stringed musical instruments which creates a magnetic field which is significantly stronger and better defined than the fields created by prior pickups such that the output thereof is rich in harmonics and far more pleasing than the output of pickups of the prior art. This is achieved by using metallic, unmagnetized pole pieces and a single permanent bar magnet for each pickup assembly. The bar magnet of each pickup assembly is rectangular, but has its direction of magnetization at a 90° angle to that used heretofore. That is, the present bar magnet has its direction of magnetization extending across the narrower dimension of the bar magnet so that the opposite surfaces define north and south poles, respectively. At least one of these opposite surfaces is flat and planar and the ends of the pole pieces remote from the strings are also made flat and planar. The bar magnet is positioned with its flat and planar surface in surface contact with the flat and planar surfaces of the pole pieces.

By providing good surface contact between the magnet and the pole pieces and by causing the magnetic lines of flux to pass from the bar magnet into the pole pieces without a change in angular direction, the ends of the pole pieces adjacent the strings are much more strongly magnetized, creating a field which is much stronger and much better defined than that encountered heretofore. The result is a superior output from an electromagnetic pickup constructed in accordance with the teachings of the present invention.

Briefly, a pickup assembly for an electrical musical instrument constructed in accordance with the teachings of the present invention comprises a plurality of magnetizable, unmagnetized pole pieces operatively associated with the strings of the instrument, the pole pieces being aligned in parallel, spaced-apart relationship, generally perpendicular to the plane of the strings, first ends of all of the pole pieces being closely adjacent to the plane of the strings, second ends of the pole pieces being flat and planar, a rectangular bar magnet having a first surface defining a north pole and an opposite second surface defining a south pole, at least one of the opposite surfaces being flat and planar, the bar magnet being positioned with the one surface thereof in surface contact with the second ends of all of the pole pieces, and coil means wound around the pole pieces.

According to another embodiment of the invention, a pickup includes two such pickup assemblies wherein the first surface of one magnet is positioned in surface contact with the second ends of all of the pole pieces of one pickup assembly and the second surface of the other magnet is positioned in surface contact with the second ends of all of the pole pieces of the other pickup assembly. An improved result is achieved if, under such circumstances, a metallic keeper is positioned in contact with the second surface of the first bar magnet and the first surface of the second bar magnet.

OBJECTS, FEATURES, AND ADVANTAGES

It is therefore an object of the present invention to solve the problems associated with electromagnetic pickups for stringed musical instruments having relatively weak magnetic fields and inadequately defined patterns of magnetic field lines. It is a feature of the present invention to solve these problems by the provision of a novel arrangement of magnetizable, unmagnetized pole pieces in combination with a rectangular bar magnet. An advantage to be derived is the provision of a pickup having a relatively strong magnetic field. A further advantage is the provision of a pickup having a well-defined pattern of magnetic field lines. A still further advantage is a pickup whose output is rich in harmonics.

Still other objects, features, and attendant advantages of the present invention will become apparent to those skilled in the art from a reading of the following detailed description of the preferred embodiments constructed in accordance therewith, taken in conjunction with the accompanying drawings wherein like numerals designate like or corresponding parts in the several figures and wherein:

BRIEF DESCRIPTION OF THE DRAWINGS

FIGS. 2–5 are enlarged perspective views, partly in section, of electromagnetic pickups constructed in accordance with the teachings of the prior art; and FIGS. 6–7 are enlarged perspective views, partly in section, of electromagnetic pickups constructed in accordance with the teachings of the present invention.

DESCRIPTION OF THE PREFERRED EMBODIMENTS

Figure 1:
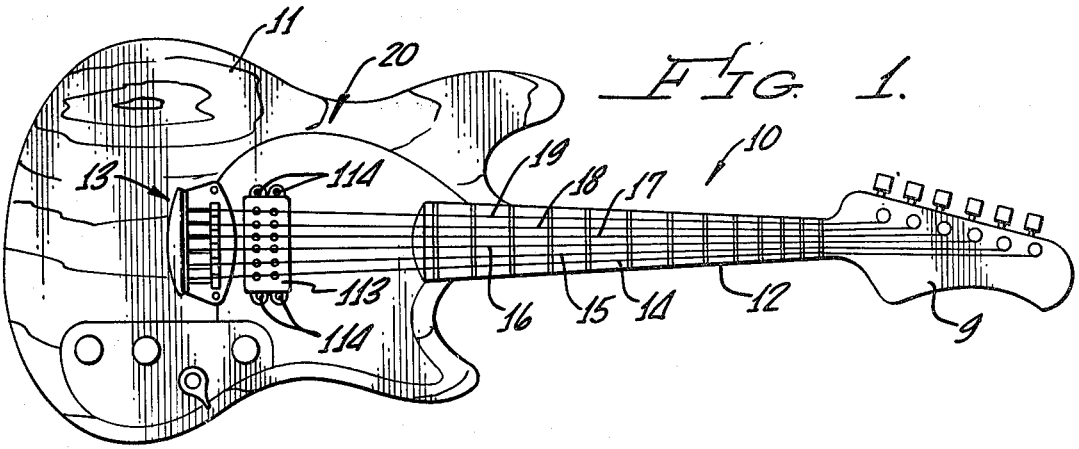
FIG. 1 is a top plan view of an electric guitar incorporating the present invention.

Referring now to the drawings and, more particularly, to FIG. 1 thereof, the present invention is illustrated as being incorporated into an electric guitar, generally designated 10, including a body 11, a neck 12, and a head 9. Tensioned between head 9 and a bridge assembly 13 connected to body 11 are a plurality of strings 14–19 which lie generally in a single plan parallel to the face of body 11. Strings 14–19 are constructed of a magnetizable material, such as steel, and are graduated in diameter in a conventional manner.

In order to derive an output from guitar 10, it is provided with an electromagnetic pickup, generally designated 20, which forms the subject matter of the present invention. Vibrations of strings 14–19, as a result of plucking or picking the same, produce an electrical signal in pickup 20, which signal may be suitably amplified and transmitted to a loudspeaker system.

Pickup 20 may be located at various longitudinal positions on body 11 in accordance with the relationship it is desired to sense between the fundamental tones and the harmonics. Furthermore, guitar 10 may be provided with multiple pickups 20, each of which would be identical to the one desired. Where multiple pickups are included, a switch may be provided to select any one or more of the pickups for conduction of its signal to the amplification system.

Figure 2:
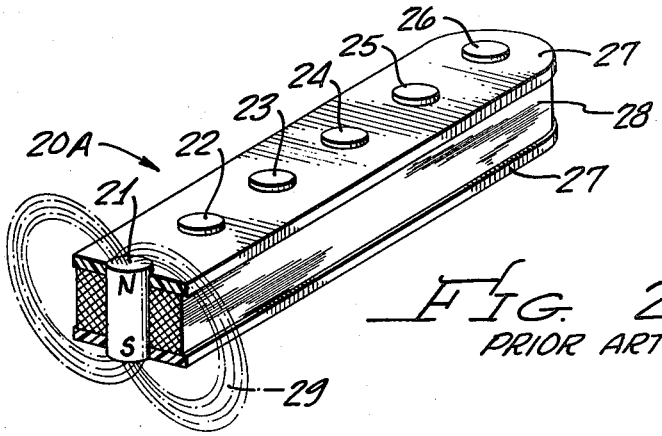
FIG. 2. PRIOR ART

Before describing the present invention in detail, a brief description will be given of the techniques utilized heretofore for magnetizing the pole pieces of an electromagnetic pickup for stringed musical instruments. More specifically, FIG. 2 shows a pickup 20A having a general configuration which is known in the prior art. Specifically, pickup 20A includes a single pickup assembly comprising a plurality of identical pole pieces 21–26 aligned generally perpendicular to the plane of strings 14–19 and positioned in parallel, spaced, closely-adjacent relationship to each other. Pole pieces 21–26 are typically held in this position by a pair of insulating support plates 27. A coil 28 formed from a large number of turns of fine conductive wire is wound around pole pieces 21–26. The wire in coil 28 is insulated, such as with varnish or lacquer, and the entire assembly comprising pole pieces 21–26, supporting plates 27, and coil 28 is typically dipped in a suitable varnish or lacquer.

According to the embodiment of FIG. 2, pole pieces 21–26 are individually magnetized and arranged so that their poles extend in the same direction. As shown, all of the north poles may be positioned closely adjacent to strings 14–19 and the south poles positioned relatively remote from strings 14–19. The orientation of pole pieces 21–26 may be reversed. With such a pickup 20A, the magnetic field lines for each pole piece are as shown at 29.

Figure 3:
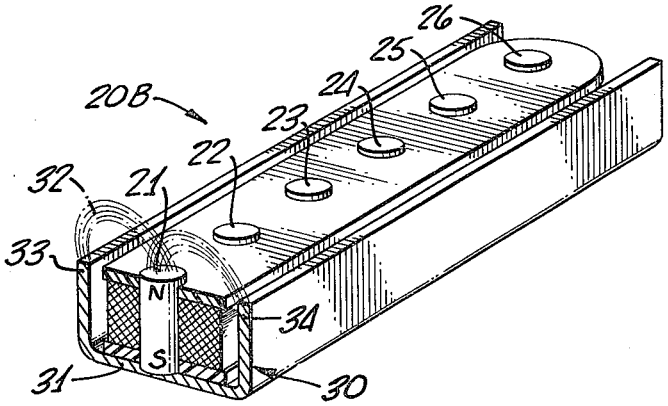
FIG. 3. PRIOR ART

In order to strengthen the magnetic field and create a magnetic field which has a better defined pattern of field lines, the embodiment of FIG. 2 may be modified as shown in FIG. 3. That is, FIG. 3 shows a pickup 20B which is identical to pickup 20A except for the addition of an elongate, generally U-shaped, metallic keeper 30. Pole pieces 21–26 and coil 28 are positioned within keeper 30 with the ends of pole pieces 21–26 remote from strings 14–19 in contact with the base 31 of keeper 30. With such a modification, the magnetic field lines for each pole piece are as shown at 32 and extend from the ends of pole pieces 21–26 adjacent strings 14–19 to the free ends 33 and 34 of keeper 30.

It is also known to provide a pickup incorporating first and second pickup assemblies, each of which is identical to pickup assembly 20A shown in FIG. 2. As described more fully hereinbefore, such a pickup can be provided in a humbucking arrangement. In such case, the two pickup assemblies would be positioned in parallel, spaced, closely-adjacent relationship, with the orientation of the pole pieces of the two pickup assemblies reversed. As a result, the magnetic field extends between the pole pieces of adjacent pickup assemblies and there is no need for a keeper as shown in FIG. 3.

Figure 4:
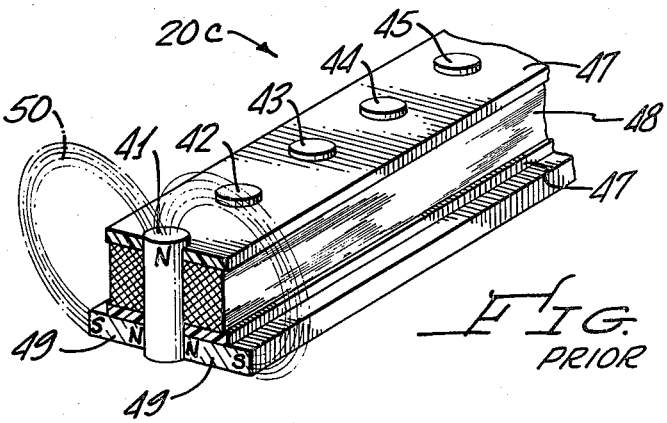
FIG. 4. PRIOR ART

For a variety of reasons, some of which have been discussed more fully hereinbefore, it is often desirable to provide a pickup in which the individual pole pieces, while being made from a metallic (magnetizable) material, are unmagnetized and to use a separate bar magnet for creating the magnetic field. In a pickup having a single pickup assembly, this is typically done as shown in FIG. 4. More specifically, FIG. 4 shows a pickup 20C having a general configuration which is known in the prior art. Pickup 20C includes a single pickup assembly comprising a plurality of identical pole pieces 41–46 aligned generally perpendicular to the plane of strings 14–19 and positioned in parallel, spaced, closely-adjacent relationship to each other. Pole pieces 41–46 are typically held in this position by a pair of insulating support plates 47. A coil 48 formed from a large number of turns of fine conductive wire is wound around pole pieces 41–46. The wire in coil 48 is insulated and the entire assembly is typically dipped in a suitable varnish or lacquer.

According to the embodiment of FIG. 4, pole pieces 41–46 are made from a magnetizable, unmagnetized material, such as iron, and the magnetic field is produced by a pair of identical rectangular bar magnets 49, each of which has its direction of magnetization extending across the wider dimension of the cross-section thereof. Magnets 49 are positioned on opposite sides of pole pieces 41–46 with the same poles, here the north poles, contacting the opposite sides of pole pieces 41–46, typically adjacent the ends thereof remote from strings 14–19. The orientation of both magnets 49 may be reversed. In any event, this causes a north pole to exist at the ends of pole pieces 41–46 closely adjacent strings 14–19. The magnetic field lines for each pole piece 41–46 are as shown at 50.

If permanent bar magnets are to be used to create the magnetic field in a humbucking-pickup having a pair of pickup assemblies, a pickup having the general configuration shown in FIG. 5 is commonly used. More specifically, FIG. 5 shows a pickup 20D having a general configuration which is known in the prior art. Pickup 20D includes a pair of pickup assemblies 51 and 61, pickup assembly 51 comprising a plurality of identical pole pieces 52–57 and pickup assembly 61 comprising a similar plurality of identical pole pieces 62–67. The number of pole pieces 52–57 and the number of pole pieces 62–67 are identical and generally the same as the number of strings 14–19.

Pole pieces 52–57 and 62–67 are aligned generally perpendicular to the plane of strings 14–19 and are positioned in parallel, spaced, closely-adjacent relationship to each other. Pole pieces 52–57 and 62–67 are typically held in position by a pair of insulating support plates 58 and 68, respectively. Coils 59 and 69 formed from a large number of turns of fine conductive wire are wound around pole pieces 52–57 and 62–67, respectively.

According to the embodiment of FIG. 5, pole pieces 52–57 and 62–67 are made from a magnetizable, unmagnetized material and the magnetic field is produced by a single rectangular bar magnet 60 having its direction of magnetization extending across the wider dimension of the cross-section thereof. The north pole of magnet 60 contacts one side edge of each of pole pieces 52–57 whereas the south pole of magnet 60 contacts one side edge of each of pole pieces 62–67. The orientation of magnet 60 may be reversed. With such a configuration, each pole piece 52–57 becomes a north pole and each pole piece 62–67 becomes a south pole so that the magnetic field lines between each pair of pole pieces are as shown at 70.

Regardless of whether the configuration of FIGS. 2, 3, 4, or 5 is used, it has been found that a relatively weak magnetic field is created and one which does not have a well-defined pattern of magnetic field lines. As a result, the coils of these pickups do not adequately respond to the vibrations of strings 14–19 and the outputs of pickups 20A–20D are not as rich in harmonics as one would like.

According to the present invention, there is provided an electromagnetic pickup for stringed musical instruments which creates a magnetic field which is significantly stronger and better defined than the fields created by pickups 20A–20D, such that the output thereof is rich in harmonics and far more pleasing than the output of prior pickups, such as pickups 20A–20D. This is achieved by using metallic, unmagnetized pole pieces and a single permanent bar magnet for each pickup assembly. Generally speaking, the bar magnet of each pickup assembly has a rectangular cross-section and has its direction of magnetization at a 90° angle to that used heretofore. That is, according to the present invention, the bar magnet has its direction of magnetization extending across the narrower dimension of the cross-section thereof so that the opposite surfaces define north and south poles, respectively. At least one of these opposite surfaces is flat and planar and the ends of the pole pieces remote from strings 14–19 are also made flat and planar. The magnet is positioned with its flat and planar surface in surface contact with the flat and planar surfaces of all of the pole pieces. The result is a superior output from an elctromagnetic pickup constructed in accordance with the teachings of the present invention.

More specifically, and with reference first to FIG. 6, there is shown a pickup, generally designated 20E, including a single pickup assembly constructed in accordance with the teachings of the present invention. The pickup assembly of pickup 20E comprises a plurality of identical pole pieces 71–76 aligned generally perpendicular to the plane of strings 14–19 and positioned in parallel, spaced, closely-adjacent relationship to each other. Pole pieces 71–76 are typically held in this position by a pair of insulating support plates 77. A coil 78 formed from a large number of turns of fine conductive wire is wound around pole pieces 71–76. As described previously, the wire in coil 78 is insulated and the entire assembly is preferably dipped in a suitable varnish or lacquer.

According to the teachings of the present invention, pole pieces 71–76 of pickup 20E are made from a metallic, magnetizable, unmagnetized material, such as iron. For reasons which will be described more fully hereinafter, each pole piece 71–76 includes an elongate, cylindrical body 79 which has an internally threaded axial bore therein, and an adjustment screw 80 positioned in the bore of each body 79. This permits individual adjustment of the spacing between each pole piece 71–76 and its associated string 14–19.

In order to create a magnetic field, pickup 20E includes a bar magnet 81 made from a permanent magnetic material or from a material which is permanently magnetized, bar magnet 81 preferably being a ceramic magnet. Bar magnet 81 has a rectangular configuration and has its direction of magnetization extending across the narrower dimension of the cross-section thereof, in the direction of arrows 82. Thus, the opposite surfaces 83 and 84 of bar magnet 81 define north and south poles, respectively.

According to the present invention, the ends of pole pieces 71–76 remote from strings 14–19 are machined such that they are flat and planar. Furthermore, at least surface 83 of magnet 81 is also flat and planar. Bar magnet 81 is positioned with surface 83 in contact with the machined ends of pole pieces 71–76. By providing good surface contact between magnet 81 and pole pieces 71–76, the magnetic lines of flux pass therebetween over a large surface area. Furthermore, it can be seen that these magnetic lines of flux pass between magnet 81 and pole pieces 71–76 without a change in angular direction.

By making this simple change in the orientation and position of bar magnet 81, a significant result has been achieved. It has been found that the change from the configuration of FIG. 4 to the configuration of FIG. 6, results in a much stronger magnetic field at the ends of pole pieces 71–76 adjacent strings 14–19. This stronger field causes a response in coil 78 which is much richer in harmonics and far more pleasing than the response in the coils of pickups 20A–20D.

Pickup 20E may include only the elements described hereinabove. Alternatively, in order to better define the magnetic field of pole pieces 71–76, pickup 20E may include a keeper 85, as described previously with regard to the embodiment of FIG. 3. With such a keeper 85, the magnetic field lines for each pole piece would be as shown at 86.

Referring now to FIG. 7, there is shown the preferred embodiment of the present invention. That is, FIG. 7 shows a humbucking pickup 20F including a pair of identical pickup assemblies 90 and 100. Pickup assembly 90 comprises a plurality of identical pole pieces 91–96 and pickup assembly 100 comprises a similar plurality of identical pole pieces 101–106. The number of pole pieces 91–96 and the number of pole pieces 100–106 are identical and usually the same as the number of strings 14–19. Pole pieces 91–96 and 101–106 are aligned generally perpendicular to the plane of strings 14–19 and are positioned in parallel, spaced, closely-adjacent relationship to each other. As just described with regard to FIG. 6, pickup assemblies 90 and 100 include pairs of insulating support plates 97 and 107, respectively, and coils 98 and 108, respectively.

The pole pieces 91–96 and 101–106 of pickup 20F are as described previously with regard to pole pieces 71–76 of pickup 20E. Pickup assemblies 90 and 100 include bar magnets 99 and 109, respectively, which are also identical to bar magnet 81. The only difference between pickup assemblies 90 and 100 is that bar magnet 99 has its north pole in contact with pole pieces 91–96 and bar magnet 109 has its south pole in contact with pole pieces 101–106. This makes each of pole pieces 91–96 a north pole and each of pole pieces 101–106 a south pole so that the magnetic field lines for each pair of pole pieces are as shown at 110.

It has been found, according to the present invention, that the strength of the magnetic field between pole pieces 91–96 and 101–106 can be further strengthened and made better defined by the addition of a keeper 111. Keeper 111 is preferably a plate of metallic, magnetizable, unmagnetized material which extends between pickup assemblies 90 and 100. That is, one surface 112 of keeper 111 is in surface contact with the south pole of magnet 99 and the north pole of magnet 109. With the addition of such a keeper 111, the magnetic lines of flux are channeled along a well-defined path, namely the body of keeper 111, from the south pole of magnet 99 to the north pole of magnet 109. By preventing any straying of the magnetic field at the bases of pole pieces 91–96 and 101–106, the field lines at the ends thereof adjacent strings 14–19 are exceptionally strong and well-defined.

For the reasons just described and perhaps others presently unknown, pickup 20F provides a superior output to those of all other known pickups, including pickup 20E. However, there are times when a musician likes the sound achieved with a pickup including a single pickup assembly. In such case, it would still be preferred to use a pickup such as pickup 20F and to simply short circuit one of coils 98 or 108. Alternatively, pickup 20E could be used, with or without keeper 85.

As is known in the prior art, pickups 20E or 20F may be mounted in a suitable recess (not shown) in body 11 of guitar 10 and held in position by a cap 113 which is secured to body 11 by means of screws 114. As is known in the art, tightening or loosening of screws 114 may be utilized to effect downward or upward movement of pickup 20E or 20F in order to adjust the distance between all of pole pieces 71–76, 91–96, and/or 101–106 and strings 14–19.

In the past, it has been the usual practice to use solid pole pieces and to adjust the spacing between all of the pole pieces and strings 14–19 as just described. This is because the magnetic field was not strong enough to make the individual adjustment of each pole piece fruitful, even though such individual adjustment was often provided. However, with the present invention, it is found that the magnetic field produced by each pole piece is so strong that slight adjustments in the spacing between any of the pole pieces and any of the strings 14–19 has a significant effect. Thus, it is the preferred embodiment of the present invention that pole pieces 71–76, 91–96, and 101–106 be made as described to permit individual adjustment of the spacing between each adjustment screw 80 and strings 14–19.

In conclusion, it is immediately apparent that pickup assemblies 20E and 20F are generally similar to pickup assemblies 20A–20D and that the change in the magnetic orientation and position of magnets 81, 99, and 109 is slight. However, this slight change yields a significantly improved result such that the outputs of pickups 20E and 20F are rich in harmonics and far more pleasing than the outputs encountered with prior art pickups.

While the invention has been described with respect to the preferred physical embodiments constructed in accordance therewith, it will be apparent to those skilled in the art that various modifications and improvements may be made without departing from the scope and spirit of the invention. For example, while it has been stated that the preferred direction of magnetization of magnets 81, 99, and 109 is across the narrower dimensions thereof, the primary reason for this is to minimize the depth of pickups 20E and 20F, which minimizes the depth of the recess in body 11 of guitar 10. Obviously, therefore, this preferred direction of magnetization is not critical to the operation of pickups 20E and 20F. Accordingly, it is to be understood that the invention is not to be limited by the specific illustrative embodiments, but only by the scope of the appended claims:

I claim:

1. A pickup assembly for an electrical musical instrument of the type including a plurality of strings which lie generally in a single plane comprising:

at least one metallic, unmagnetized pole piece operatively associated with said strings of said instrument, a first end of said pole piece being closely adjacent to said plane of said strings, a second opposite end of said pole piece being relatively remote from said plane of said strings;

a bar magnet having a first surface defining a north pole and an opposite second surface defining a south pole, said bar magnet being positioned with one of said surfaces thereof in surface contact with said second end of said pole piece; and coil means wound around said pole piece.

2. A pickup assembly according to claim 1, wherein the thickness of said magnet between said first and second surfaces is less than the thickness of said magnet between the remaining opposite surfaces thereof.

3. A pickup assembly for an electrical musical instrument of the type including a plurality of strings which lie generally in a single plane comprising:

a plurality of magnetizable, unmagnetized pole pieces operatively associated with said strings of said instrument, said pole pieces being aligned in parallel, spaced-apart relationship, generally perpendicular to said plane of said strings, first ends of all of said pole pieces being closely adjacent to said plane of said strings, second ends of said pole pieces being flat and planar;

an elongate bar magnet having a rectangular cross-section, a first side surface defining a north pole, and an opposite second side surface defining a south pole, at least one of said opposite surfaces being flat and planar, said bar magnet being positioned with said one surface thereof in surface contact with said second ends of all of said pole pieces; and coil means wound around said pole pieces.

4. A pickup assembly according to claim 3, wherein said pole pieces are made from iron.

5. A pickup assembly according to claim 3, wherein said pole pieces are elongate, cylindrical members.

6. A pickup assembly according to claim 5, wherein each pole piece has an internally threaded axial bore therein and further comprising:

an adjustment screw positioned in the bore of each pole piece.

7. A pickup assembly according to claim 3, wherein said bar magnet is made from a permanent magnetic material.

8. A pickup assembly according to claim 3, wherein said bar magnet is a permanent ceramic magnet.

9. A pickup assembly according to claim 3, wherein the thickness of said magnet between said first and second side surfaces is less than the thickness of said magnet between the remaining two side surfaces thereof.

10. A pickup assembly according to claim 3, further comprising:

an elongate, generally U-shaped, metallic keeper having a base and spaced, parallel sides connected to opposite sides of said base, said pole pieces, bar magnet, and coil means being positioned within said keeper, between said side surfaces thereof, with the other of said opposite side surfaces of said magnet in contact with said base of said keeper.

11. A pickup for an electrical musical instrument of the type including a plurality of strings which lie generally in a single plane comprising:

a first pickup assembly comprising:

a first plurality of metallic, unmagnetized pole pieces operatively associated with said strings of said instrument, said first pole pieces being aligned in parallel, spaced-apart relationship, generally perpendicular to said plane of said strings, first ends of all of said pole pieces being closely adjacent to said plane of said strings, second ends of said pole pieces being flat and planar;

a first elongate bar magnet having a rectangular cross-section, a first side surface defining a north pole, and an opposite second side surface defining a south pole, said first surface being flat and planar, said bar magnet being positioned with said first surface in surface contact with said second ends of all of said first pole pieces; and first coil means wound around said first pole pieces; and a second pickup assembly comprising:

a second plurality of metallic, unmagnetized pole pieces operatively associated with said strings of said instrument, said second pole pieces being aligned in parallel, spaced-apart relationship, generally perpendicular to said plane of said strings, first ends of all of said second pole pieces being closely adjacent to said plane of said strings, second ends of said second pole pieces being flat and planar;

a second elongate bar magnet having a rectangular cross-section, a first side surface defining a north pole, and an opposite second side surface defining a south pole, said second surface of said second bar magnet being flat and planar, said second bar magnet being positioned with said second surface thereof in surface contact with said second ends of all of said second pole pieces; and second coil means wound around said second pole pieces.

12. A pickup according to claim 11, further comprising:

a metallic keeper plate in contact with said second surface of said first bar magnet and said first surface of said second bar magnet.

13. A pickup according to claim 11 or 12, wherein said first and second pole pieces are made from iron.

14. A pickup according to claim 11 or 12, wherein said first and second pole pieces are elongate, cylindrical members.

15. A pickup according to claim 14, wherein each pole piece has an internally threaded axial bore therein and further comprising:

an adjustment screw positioned in the bore of each pole piece.

16. A pickup according to claim 11 or 12, wherein said first and second bar magnets are made from a permanent magnetic material.

17. A pickup according to claim 11 or 12, wherein the thickness of said first and second magnets between said first and second side surfaces thereof is less than the thickness of said first and second magnets between the remaining side surfaces thereof.

* * * * *